United States Patent [19]

Simon, Jr. et al.

[11] Patent Number: 4,889,582

[45] **Date of Patent: * Dec. 26, 1989**

[54] AGE HARDENABLE DISPERSION STRENGTHENED HIGH TEMPERATURE ALUMINUM ALLOY

[75] Inventors: James W. Simon, Jr., Jupiter; Kathleen Gorman, W. Palm Beach, both of Fla.

[73] Assignee: United Technologies Corporation, Hartford, Conn.

[ * ] Notice: The portion of the term of this patent subsequent to Mar. 3, 2004 has been disclaimed.

[21] Appl. No.: 923,781

[22] Filed: Oct. 27, 1986

[51] Int. Cl.[4] ..... C22F 1/04

[52] U.S. Cl. ..... 148/12.7 A; 75/249; 148/415; 419/66; 419/67; 420/551

[58] Field of Search ..... 420/551; 419/66, 67; 75/249; 148/11.5 P, 12.7 A, 415, 437

[56] References Cited

U.S. PATENT DOCUMENTS

| | | | |
|---|---|---|---|
| 1,579,481 | 4/1926 | Hybinette | 420/550 |
| 1,675,708 | 7/1928 | Hybinette | 420/550 |
| 2,963,570 | 12/1960 | Rieppel | 219/74 |
| 2,963,780 | 12/1960 | Lyle, Jr. et al. | 29/182 |
| 2,967,351 | 1/1961 | Roberts et al. | 29/420.5 |
| 3,147,110 | 9/1964 | Foerster | 75/122.5 |
| 3,625,677 | 12/1968 | Jones | 75/138 |
| 3,899,820 | 8/1975 | Read et al. | 29/420 |
| 4,025,249 | 5/1977 | King | 425/6 |
| 4,053,264 | 10/1977 | King | 425/8 |
| 4,078,873 | 3/1978 | Holiday et al. | 425/8 |
| 4,265,676 | 5/1981 | Nes et al. | 148/2 |
| 4,313,759 | 2/1982 | Raybould | 75/249 |
| 4,347,076 | 8/1982 | Ray et al. | 75/0.5 R |
| 4,647,321 | 3/1987 | Adam | 148/415 |

OTHER PUBLICATIONS

W. Rostoker, R. P. Dudek, C. Freda and R. E. Russell, "Fast Freezing by Atomization for Aluminum Alloy Development", *International Journal of Powder Metallurgy*, pp. (139)–(148), 9 (4) 1973.

A. N. Bryukhovets, N. N. Barbasshin, M. G. Stepanova, and I. N. Fridlyander, "Structures and Properties of Al–CR and Al–Fe Alloys Prepared by the Atomization Technique", Moscow Aviation Technology Institute, translated from *Poroshkovaya Metallurgiya*, No. 1 (85), pp. 108–111, Jan. 1970.

V. I. Dobatkin and V. I. Elagin, "On Aluminum Alloys with Refractory Elements, obtained by Granulation", *Sov. J. Non Ferrous Metals*, Aug. 1966, pp. 89–93.

Sharon L. Langenbeck, Walter M. Griffith, Gregory J. Hildeman and Jim W. Simon, "Development of Dispersion–Strengthened Aluminum Alloys", ASTM Special Technical Publication 890, ASTM Publication Code Number (PCN) 04–890000–04, pp. 410–422, published Jun. 1986.

*Primary Examiner*—Richard O. Dean

*Attorney, Agent, or Firm*—Charles E. Sohl

[57] ABSTRACT

A stable age hardenable aluminum alloy which has useful mechanical properties at temperatures up to at least 900° F. (482° C.). The alloy contains 5–15% iron, 1–5% molybdenum and 0.2–6% vanadium with balance aluminum and is processed by rapid solidification from the melt to form a particulate which is consolidated to form a bulk article.

1 Claim, 1 Drawing Sheet

AGE HARDENABLE DISPERSION STRENGTHENED HIGH TEMPERATURE ALUMINUM ALLOY

CROSS REFERENCE TO RELATED APPLICATION

Attention is directed to commonly assigned copending U.S. patent application Ser. No. 540,712, entitled "Dispersion Strengthened Aluminum Alloys", filed on Oct. 13, 1983 which has been allowed and is incorporated herein by reference U.S. Pat. No. 4,647,321.

TECHNICAL FIELD

This invention relates to aluminum alloys processed by powder metallurgy techniques which are dispersion strengthened and age hardenable and have useful mechanical properties at elevated temperatures, at least up to 800° F. (425° C.).

BACKGROUND ART

Attempts have been made in the prior art to provide improved aluminum alloys by powder metallurgy techniques. These techniques provide increased solidification rates over rates obtained in conventional casting. However, the solidification rates obtained have not been sufficiently great to produce useful metastable phases in the limited number of alloy systems which have been studied.

The following journal articles deal with rapid solidification processing of aluminum alloys:

"Exchange of Experience and Information, Structures and Properties of Al-Cr and Al-Fe Alloys Prepared by the Atomization Technique". A. A. Bryukhovets, N. N. Barbashin, M. G. Stepanova, and I. N. Fridlyander. Moscow Aviation Technology Institute. Translated from Poroshkovaya Metallurgiya, No. 1 (85), pp. 1081–111, January, 1970.

"On Aluminum Alloys with Refractory Elements, Obtained by Granulation" by V. I. Dobatkin and V. I. Elagin. Sov. J. NonFerrous Metals August 1966, pp. 89–93.

"Fast Freezing by Atomization for Aluminum Alloy Development" by W. Rostoker, R. P. Dudek, C. Freda and R. E. Russell. International Journal of Powder Metallurgy, pp. 139–148.

The following U.S. Patent Numbers relate to aluminum alloys and the rapid solidification of aluminum alloys: U.S. Pat. Nos.

1,579,481
1,675,708
2,963,570
2,963,780
2,967,351
3,147,110
3,625,677
3,899,820
4,025,249
4,078,873
4,053,264
4,265,676
4,313,759
4,347,076

Disclosure of Invention

A major object of this invention is to describe aluminum alloys having useful mechanical properties at temperatures up to at least about 800° F. (425° C.).

It is another object of the invention to describe the processing of such alloys by powder metallurgy techniques.

This invention relates to a class of aluminum alloys which are dispersion strengthened and which can be aged hardened for improved mechanical properties.

Precipitation strengthening in aluminum alloys is well known as typified by alloys based on the aluminum copper system. In these alloys precipitation of particles is thermally controlled to produce a strengthening effect.

Another type of alloy strengthening by particles is known as SAP (sintered aluminum powder) alloys. SAP alloys are produced by powder metallurgy techniques in which aluminum alloy powder is oxidized, compacted and cold worked to produce a structure containing a fine dispersion of aluminum oxide particles. Since aluminum oxide is essentially insoluble in aluminum this class of alloys is more stable at elevated temperatures than precipitation strengthened alloys formed by true precipitation phenomena. However, SAP alloys are costly and their mechanical properties are established by deformation rather than by thermal treatment.

The present invention concerns a class of alloys which combines some characteristics of both types of precipitation hardened materials previously described. The invention alloys are strengthened by a precipitate based on iron, molybdenum and vanadium. Iron, molybdenum and vanadium all are essentially insoluble in aluminum and as a consequence precipitate particles elevated temperatures.

The invention alloys are prepared by process which includes rapid solidification from the melt at rates which exceed $10^{3}$° C. per second and preferably $10^{5}$° C. per second. The rapid solidification ensures that the precipitate particles which form during solidification are fine and uniformly dispersed. Additionally, it seems likely that the particles which form during rapid solidification are not of equilibrium structure in view of the age hardening response discussed below. If the solidification rate is sufficiently high, noncrystalline (amorphous) regions may result. This is generally not a preferred situation since such material has limited ductility. However, such material can be subsequently thermally treated to decompose the amorphous material into more ductile, crystalline material containing a fine, strengthening, dispersion of precipitate particles.

The solidified particulate is compacted to form article of useful dimensions. A variety of compaction techniques can be employed so long as the alloy temperature does not rise significantly above about 450° C. for any significant length of time.

A feature of the present invention material which distinguishes it from a prior aluminum alloy containing iron and molybdenum but without vanadium (described in U.S. Ser. No. 540,712 filed Oct. 13, 1983), is that the invention material displays an age hardening response which can be used develop optimum mechanical properties. While the age hardening kinetics and the degree of hardening observed will vary with composition, a typical result is an increase of about 4 points on the Rockwell B scale when the material is aged at temperatures between about 825° and 925° F. (455–482° C.) for periods between about 1 and 50 hours.

The foregoing, and other features and advantages of the present invention will become more apparent from the following description and accompanying drawings.

BEST MODE FOR CARRYING OUT THE INVENTION

Figure 1:
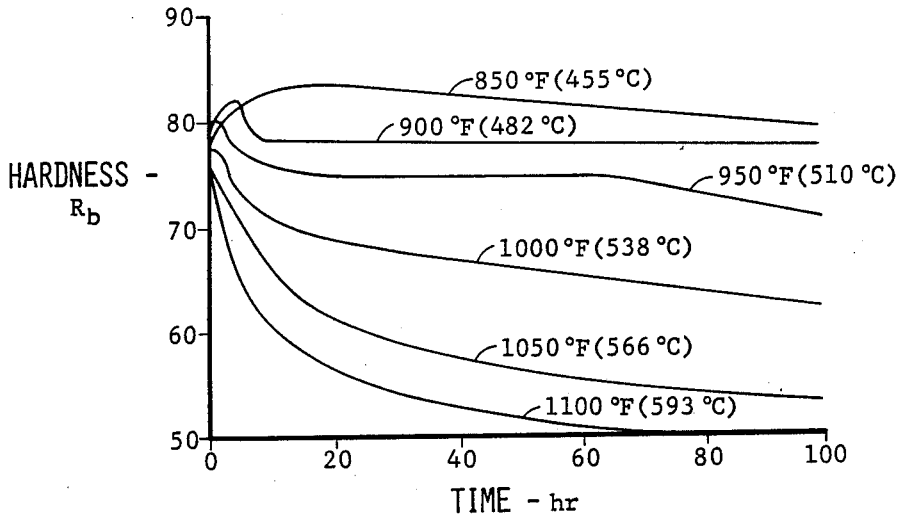
FIG. 1 shows the thermal stability of an aluminum alloy according to the present invention containing 8% Fe, 2% Mo, 1% V.

The invention alloys are based on aluminum and contain (by weight) from 5–15% iron, from 1–5% molybdenum and from 0.2–6% vanadium. A preferred range is 6–10% iron, 1–4% molybdenum; 0.5–2% vanadium, balance aluminum. Preferably the total weight percent content of the alloying elements does not exceed about 20%, the sum of molybdenum and vanadium constitute from about 20% to about 200% of the iron content and preferably the molybdenum content exceeds the vanadium content.

In the prior alloy which contained nominally 8% iron and 2% molybdenum in aluminum, a strengthening phase based on $Al_3Fe$ was formed with the molybdenum partially substituting for iron. Although definitive analysis is not complete on the invention alloy, the strengthening phase is believed to be based on $Al_3Fe$ with the molybdenum and vanadium again substituting for some of the iron. However, the role which vanadium plays in the alloy is complex since vanadium appears to participate in the age hardening response observed in the invention material.

A broad description of the invention material after rapid solidification is that it is an aluminum matrix which contains from about 5 to about 30 volume percent of a strengthening phase based on iron, molybdenum and vanadium having a structure similar to $Al_3Fe$. In material which has been processed to achieve maximum strength the strengthening particles have an average diameter of less than about 500 angstroms and preferably less than 300 angstroms and are spaced less than about 2000 angstroms apart.

The production of such a structure requires rapid solidification from the melt. We have accomplished this solidification using a spinning disk atomizer which is spun at a rate of 20,000–35,000 rpm while the molten material to be atomized is poured on the disk. Centrifugal force throws the liquid material off the disk and it forms particles which are cooled by jets of helium gas at a rate of at least about $10^5$° C. per second. This process is described in U.S. Pat. Nos. 4,025,249, 4,053,264 and 4,078,873 which are incorporated herein by reference. While this is the preferred solidification process, to the best of our knowledge the significant feature is the cooling rate rather than the process specifics and we believe that other cooling processes including melt spinning, splat cooling etc. could be used to produce an equivalent microstructure in the invention composition.

Once the material is produced in particulate form, the particulate must be compacted to form an article of useful size. Such compaction may be performed using a variety of processes which are known to those skilled in the art. A necessary condition is that the material not be exposed to an excessive temperature since this could result in an undesirable amount of precipitate coarsening and would eliminate the possibility of subsequently age hardening the composition. Accordingly, it is preferred that the material not be exposed to temperatures in excess of about 800° F. (425° C.) for any significant amount of time during the compaction process.

We have successfully used hot extrusion of canned powder at temperatures of about 572° F. (300° C.). Another potentially useful compaction technique is dynamic compaction using explosive shock waves to bond the powder particles together without producing a significant temperature increase.

Figure 2:
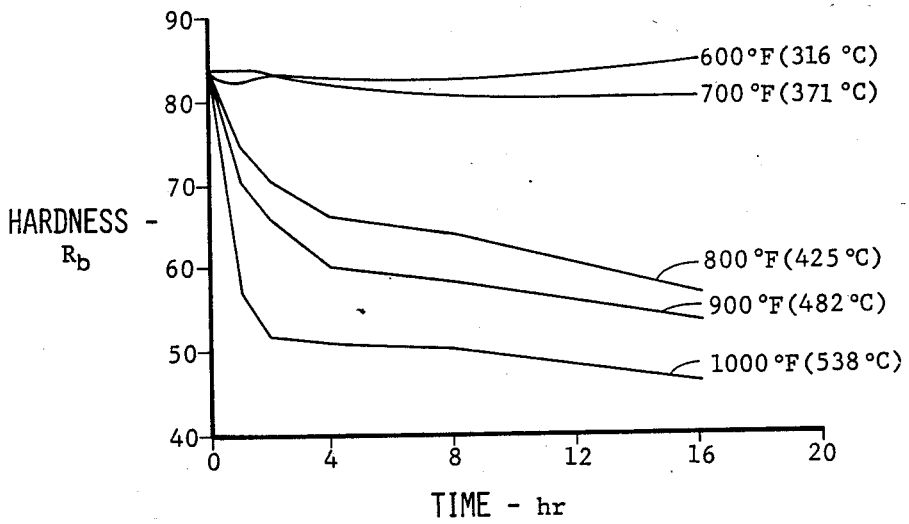
FIG. 2 shows the thermal stability of a prior aluminum alloy containing 8% Fe and 2% Mo.

The benefits of the invention are shown in part in FIGS. 1 and 2. FIG. 1 shows the room temperature hardness of invention material (Aluminum-8%Fe-2%Mo-1%V) after exposure at different temperatures and times. A significant feature of FIG. 1 is the presence of an age hardening peak on the 850° F. (455° C.) and 900° F. (482° C.) temperature curves. For the 850° F. curve, peak hardness appears after about 20 hours while at 900° F. peak hardness is much more pronounced and occurs at about 4 hours. The curve also shows that for temperatures up to at least 900° F. (482° C.) the hardness of the material remains essentially constant with temperature (after the age hardening peak) for exposure times of up to 100 hours. At 950° F. the invention material hardness appears to diminish at 100 hours. This shows that the material is thermally stable at up to at least 900° F. for at least 100 hours.

The information in FIG. 1 should be contrasted with the similar curves shown in FIG. 2 for the aluminum 8% iron, 2% molybdenum alloy described in U.S. Ser. No. 540,712 U.S. Pat. No. 4,647,321. FIG. 2 shows that at 800° F. the material is thermally unstable, and after 16 hours at 800° F. the Rockwell B hardness is less than 60 contrasted with the Rockwell B hardness of about 78 for the invention material shown in FIG. 1 after 100 hours at 900° F. The prior art material is unstable at 800° F. for any exposure time. FIG. 2 is also devoid of any indication of an age hardening response.

It should be noted that the age hardening response shown in the invention alloy is different in kind from that displayed in other common age hardening aluminum systems such as aluminum copper. In such known systems the age hardening response can be obtained repeatedly in the solid state by appropriate thermal cycling about the precipitate solvus temperature. This is not the case with the present material since the age hardening response is observed only once after rapid solidification and cannot be repeated without remelting and resolidifying the material. This suggests that the invention material uses vanadium to build on the properties of the $Al_3Fe$ base precipitate observed in the prior aluminum -8% iron-2% molydbenum and that this increase in precipitate hardening possibly results from some irreversible diffusion of vanadium into or out of the precipitate particles. This feature of the invention is mentioned here inasmuch as it comprises valuable information regarding the nature of the invention and suggests that the invention age hardening response is dissimilar to those observed in other systems.

Although this invention has been shown and described with respect to detailed embodiments thereof, it will be understood by those skilled in the art that various changes in form and detail thereof may be made without departing from the spirit and scope of the claimed invention.

We claim:

1. A method for producing a high temperature aluminum article from an alloy consisting of 5–15% iron, 1–5% molybdenum, 0.2–6 vanadium, balance essentially aluminum including the steps of:

a. melting the composition;

b. solidifying the composition at a rate in excess of about $10^{3°}$ C. per second to form a particulate;

c. consolidating the particulate at a temperature below about 800° F.;

e. heat treating at a temperature between about 800° F. and 1000° F. for a period of time from about 1 to about 100 hours to produce an age hardened material.

* * * * *